United States Patent [19]

Seiderman

[11] 4,220,071

[45] Sep. 2, 1980

[54] CONVERSION KIT FOR SEMI-AUTOMATIC CARBINES

[76] Inventor: Abe Seiderman, 3740 E. 10th Ct., Hialeah, Fla. 33013

[21] Appl. No.: 896,646

[22] Filed: Apr. 17, 1978

[51] Int. Cl.[3] ..... F41D 7/03

[52] U.S. Cl. ..... 89/128; 42/49 A; 42/77; 89/197

[58] Field of Search ..... 42/77; 89/29, 128, 194, 89/197

[56] References Cited

U.S. PATENT DOCUMENTS

| | | | |
|---|---|---|---|
| 681,481 | 8/1901 | Johnson | 89/194 |
| 2,027,892 | 1/1936 | Williams | 89/29 |
| 2,329,273 | 9/1943 | Kelly | 42/77 |
| 2,452,510 | 10/1948 | Wallenberg | 42/77 |
| 3,776,095 | 12/1973 | Atchisson | 42/77 |
| 4,003,292 | 1/1977 | Christakos | 89/194 |
| 4,127,056 | 11/1978 | Kart | 89/128 |

FOREIGN PATENT DOCUMENTS

| | | | |
|---|---|---|---|
| 46138 | 2/1929 | Norway | 42/77 |

*Primary Examiner*—Stephen C. Bentley
*Attorney, Agent, or Firm*—Ernest H. Schmidt

[57] ABSTRACT

A conversion system for .30 caliber semi-automatic carbines permits selective use with .22 caliber ammunition. Modified barrel, bolt, operating slide and magazine sub-assemblies easily replace the corresponding original sub-assemblies to provide for direct blow-back operating slide actuation with .22 caliber ammunition. The replacement parts are of such simplified construction as permits manufacturing and sales as a conversion kit at a fraction of the original cost of the .30 caliber carbine to be converted. The conversion technique also provides for the independent manufacture of a unique .22 caliber semi-automatic carbine having the general appearance and "feel" of the standard .30 caliber M1 carbine.

4 Claims, 11 Drawing Figures

CONVERSION KIT FOR SEMI-AUTOMATIC CARBINES

This invention relates to firearms and is directed particularly to a method and means for converting a standard .30 caliber M1 standard military issue carbine to .22 caliber use. The invention is directed particularly to the provision, for the first time, of a method and means for converting the standard .30 caliber M1 or M1A1 carbine for .22 caliber operation with minimal effort with little expense by use of a novel conversion kit which substitutes the original barrel, bolt, operating slide and magazine. The invention also contemplates use of the conversion method or technique in the manufacture or remanufacture of a .22 caliber semi-automatic carbine having most of the structural features of the standard .30 caliber M1 or M1A1 military carbine, including overall size, weight, appearance, operating mechanism, "feel" and firing qualities.

Copies of the .30 caliber semi-automatic gas actuated carbine, well-known as the basic military semi-automatic firearm used by the United States Armed Forces, have proven to be very popular for sports use. Among its many advantages are its simplicity of construction permitting easy disassembly for cleaning, inspection and repair of its various sub-assemblies including the gunstock, receiver, barrel, bolt, operating slide mechanism and trigger mechanism. It is the principal object of this invention to provide substitute bolt, barrel, operating slide and magazine sub-assemblies designed to convert such standard government issue .30 caliber M1 carbines or M1A1 to .22 caliber semi-automatic use. Since the combined cost of these replaced parts or sub-assemblies are only a small fraction of the cost of the .30 carbine to be converted, they can be advantageously supplied in kit form for use by the owner of a standard .30 caliber carbine whenever he wishes to use his rifle for small game hunting for example, or to save on ammunition expense when using the firearm for target practice.

A more particular object of the invention is to provide a conversion kit of the character described wherein the substitute .22 caliber barrel is integrally formed with a breech extension portion, which, when assembled to the standard .30 caliber M1 or M1A1 carbine receiver, blocks the forwardmost portion of the receiver to prevent rotary camming of the bolt assembly at the front end of the receiver when operated upon by the slide mechanism, thereby providing direct blowback of the ignition gasses for activating the slide mechanism upon recoil for semi-automatic operation.

Another object of the invention is to provide a conversion kit of the above nature wherein the standard slide can be modified for the conversion simply by cutting off the weighted forward end portion thereof.

Still another object of the invention is to provide a conversion kit for .30 caliber M1 or M1A1 carbines wherein the bolt assembly has a rim-fire firing pin and spring actuated hook means for engaging and withdrawing a spent .22 caliber shell for automatic ejection during recoil.

Yet another object of the invention is to provide a conversion kit for .30 caliber M1 or M1A1 carbines including a modified magazine for automatic feeding of .22 caliber ammunition, the magazine being directly receivable in the receiver magazine slot.

Other objects, features and advantages of the invention will be apparent from the following description when read with reference to the accompanying drawings. In the drawings, wherein like reference numerals denote corresponding parts throughout the several views:

FIG. 5 is a fragmentary top view of the firearm as illustrated in FIG. 4;

FIG. 7 is a side elevational view of the modified magazine for automatic feeding of .22 caliber ammunition, shown separately and with a portion broken away to reveal constructional details;

Figure 1:
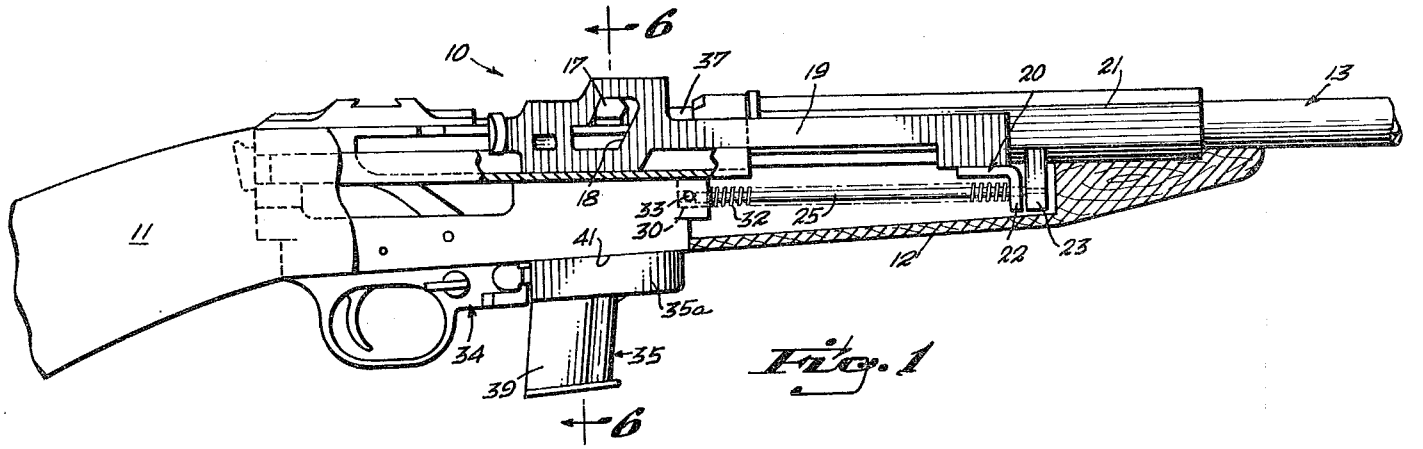
FIG. 1 is a right side elevational view of a firearm embodying the invention, with portions broken away to reveal the constructional details.

Referring now in detail to the drawings, reference numeral 10 designates generally a typical firearm embodying the invention, the same comprising a method and means for converting a semi-automatic M1 or M1A1 carbine .30 caliber rifle to .22 caliber semi-automatic operation. Since constructional details of the standard military .30 caliber M1 or M1A1 carbine are well-known, only such details thereof as are deemed to be necessary for a full understanding of the present invention are described in detail. In this connection it is to be noted that the version of the .30 caliber carbine illustrated in FIGS. 1 through 5 just described herein is an improved model of the original M1 carbine. The invention is of course also directly applicable to the standard military .30 caliber M1 (or M1A1) carbine in its original form, as illustrated in FIGS. 8 through 11 hereinafter described.

The firearm 10 comprises the usual stock 11 and hand grip 12 which, together, support the barrel and receiver assembly 13, 14, said barrel being removably assembled to said receiver by interthreading connection, as is hereinafter more particularly described. The bolt assembly 15 is reciprocatively slidable within a bore 16 formed in receiver 14, said bolt assembly having an integrally formed projection or lug 17 normal thereto and engaged in an irregular camming aperture 18 in operating slide 19, as shown. The forward end of the operating slide 19 has secured thereto a right-angular bracket 20 extending under the increased diameter rear portion 21 of barrel 13. The bracket 20 has integrally formed therewith a right-angular, downwardly-extending portion 22 which, when the operating slide 19 is in its forwardmost position and holding the bolt assembly 15 in firing position, will be in closely-spaced, parallel relation with respect to a support block 23 extending downwardly of the underside of rear barrel portion 21. The operating slide 19 is guided for reciprocation through a predetermined distance by a pair of guide rods 24, 25 extending through spaced openings 26, 27 in slide bracket portion 22, said rods being supported in spaced, parallel relation with respect to barrel 13 by having reduced-diameter forward end portions fitted in openings in support block 23, and having rear end portions retained in through passage assembly openings 28, 29 in block 30 forming an integral part of receiver 14. In assembly, operating slide springs 31, 32 are disposed circumjacent respective rods 24, 25, being constrained between downwardly extending bracket portion 22 and support block 30. A cross pin 33 in support block 30 retains operating slide guide rods 24, 25, operating slide springs 31, 32 and operating slide 19 in assembled relation, with said operating slide and associated bolt assembly 15 constrained in the forward or firing position by said springs, as illustrated in FIGS. 1, 2, and 3.

Figure 2:
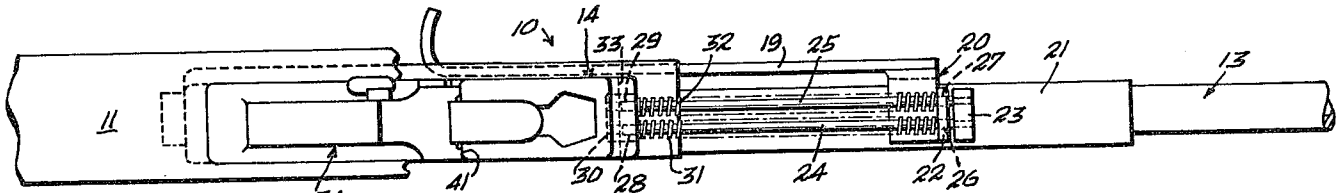
FIG. 2 is a fragmentary bottom view thereof.
Figure 3:
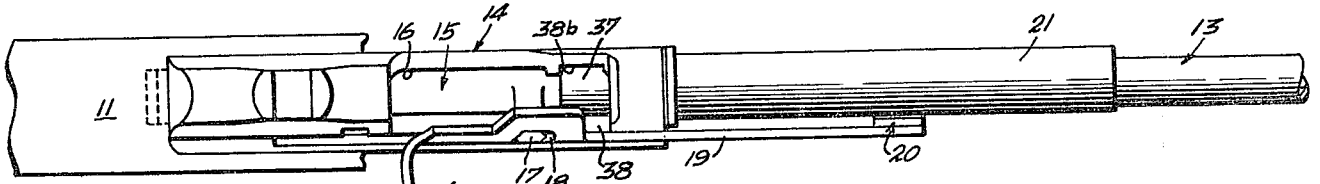
FIG. 3 is a fragmentary top view thereof.
Figure 4:
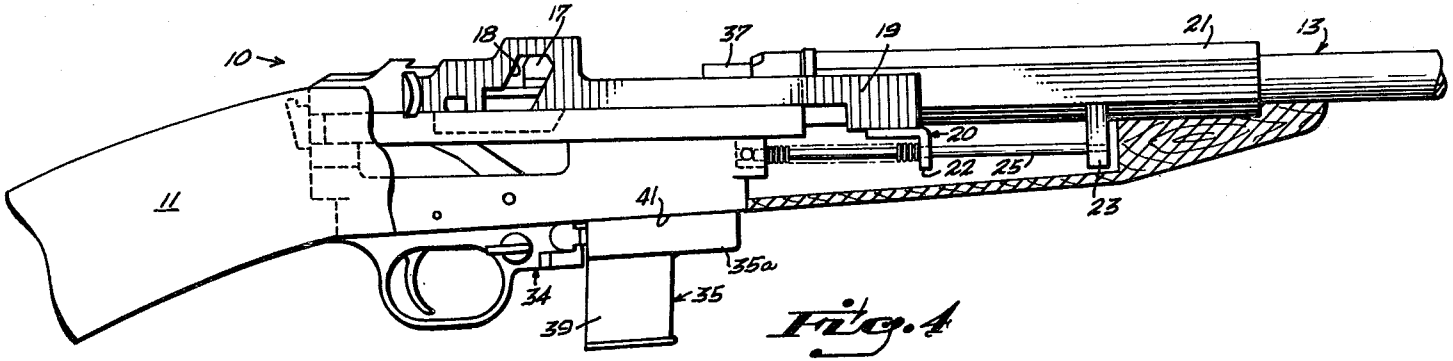
FIG. 4 is a right elevational view similar to that of FIG. 1 but showing the operating slide assembly and associated bolt assembly in fully open position.
Figure 3:
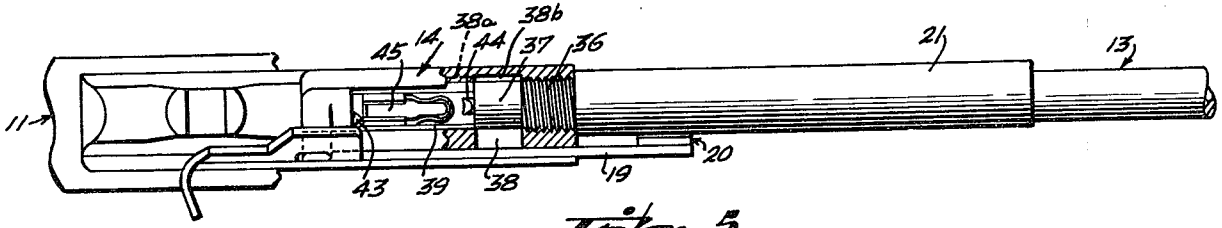
Figure 1:
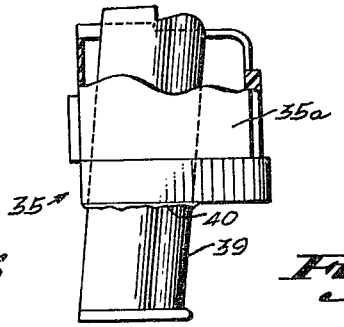

The trigger housing assembly 34, which is of standard construction and forms no part of the present invention other than as a support for a modified cartridge magazine 35 in the manner and for the purpose hereinafter particularly described, is removably locked at its rear end to the receiver 14, and straddles block 30 at its forward end as illustrated in FIGS. 1 and 2, to be retained in place by the cross pin 33 described above as retaining means for operating slide guide rods 24, 25.

As herein described and illustrated, the semi-automatic firearm 10 is a modified version of the standard .30 caliber M1 (or M1A1) carbine supplied as government issue to the United States Armed Forces, differing also in the substitution of a modified barrel 13, bolt assembly 15, operating slide 19, and magazine 35 for converting the basic .30 caliber carbine to semi-automatic or single shot .22 caliber ammunition in accordance with my invention. Since the standard semi-automatic M1 or M1A1 can readily be disassembled, it is a simple matter to substitute the modified barrel 13, bolt assembly 15, operating slide 19 and magazine 35 to convert the carbine to .22 caliber ammunition use in the following manner.

Barrel 13, having a .22 caliber bore is threaded at the breech end as indicated at 36, FIG. 5 to be threadingly received in the internally-threaded forward end of receiver 14 as replacement for the .30 caliber barrel originally supplied. As best illustrated in FIGS. 1 and 3 the replacement barrel 13 is integrally formed with a breech end extension 37 against which the bolt assembly 15 is normally held in abutting engagement by means of spring-pressed operating slide 19, as described above. In this connection it is to be particularly noted that with this barrel modification the bolt assembly projection 17 will not move forwardly enough to be cammed in receiver slot 38, as in standard .30 caliber ammunition operation. Nor could the guide lug **38*a* of the bolt assembly 15 otherwise move forwardly to the receiver slot 38*b* which, in the modification, will be blocked by the breech extension end 37 of replacement barrel 13**.

I have found that because of the substantially lower chamber pressure generated upon firing of a .22 caliber shell, direct blow-back of the gasses of ignition can be utilized to produce satisfactory recoil of the bolt operating slide mechanism for semi-automatic operation. Since in the conversion the operating slide 19 is no longer directly actuated by the gas port cylinder piston comprising the standard .30 caliber barrel which is replaced, this slide actuating mechanism is omitted in the modified barrel 13, as well as in the slide 19, which as described above has previously been modified for guidance along operating slide guide rods 24, 25 in the improved version of the M1 (or M1A1) carbine illustrated in FIGS. 1 through 5. This modification of the operating slide, moreover, permits decreasing its weight in accordance with inerta requirements of the slidable bolt assembly and operating slide mechanism for optimim firing pressures consistent with the release of sufficient blow-back gasses to effect recoil and counter-recoil action for semi-automatic operation.

Figure 6:
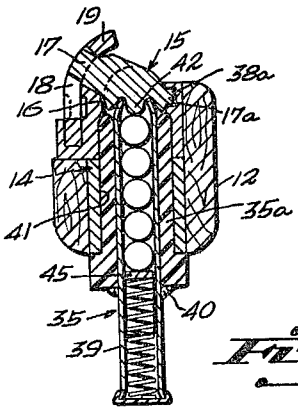
FIG. 6 is a vertical cross-sectional view taken along the line 6—6 of FIG. 1 in the direction of the arrows.

For semi-automatic operation of the .30 caliber carbine when converted for operation with .22 caliber ammunition, the magazine 35 must be modified to accommodate .22 caliber bullets. As illustrated in FIGS. 6 and 7 this is accomplished by fixing the comparatively small, standard .22 caliber magazine 39 within the cut away upper end portion of an empty casing **35*a* of the .30 caliber magazine, as illustrated. As illustrated in FIGS. 6 and 7, a suitable epoxy adhesive 40 can be used for properly positioning the .22 caliber magazine 39 within the .30 caliber magazine casing portion 35*a* in such position that when the loaded magazine assembly 35 is fitted within the magazine opening 41 in the receiver 14, the uppermost cartridge constrained in its magazine delivery position by follower 45, will be in proper position for engagement by the nose 42 at the forward end of bolt assembly 15 (see FIG. 6). The bolt assembly 15 also differs from the standard .30 caliber carbine bolt in that the firing pin is positioned for rim firing instead of center firing, and in that a forwardly projecting, radially-spring-pressed shell rim catch member 43 is utilized in withdrawal for extraction of a spent shell during recoil after a .22 caliber round has been fired. The modified bolt assembly 15 for .22 caliber use, because its extent of reciprocative travel is substantially less than that required of the original .30 caliber bolt mechanism, will be of substantially lesser weight, as required for direct blow-back recoil operation with .22 caliber ammunition, such decrease in operating weight together with decreases in weight of the modified operating slide 19** described above resulting in a combined weight of approximately 6½ ounces, providing the mass required for proper semi-automatic operation with internal pressures developed by the firing of .22 caliber rounds of ammunition.

In operation, it will be understood that the operating slide springs 31, 32 serve to urge the operating slide and bolt assembly 19, 15 in forewardmost position against the breech at the rear end of the barrel 13 and within the receiver 14. A .22 caliber round will have been engaged and slid forwardly into the barrel chamber at the breech during counter-recoil action as effected by the operating slide springs 31, 32. As illustrated in FIG. 5, a guide ramp projection 44 at the breech end of the modified barrel 13 serves to guide the nose of the bullet into the firing chamber upon closure of the bolt assembly at the breech during counter-recoil action of the bolt slide assembly mechanism.

Figure 8:
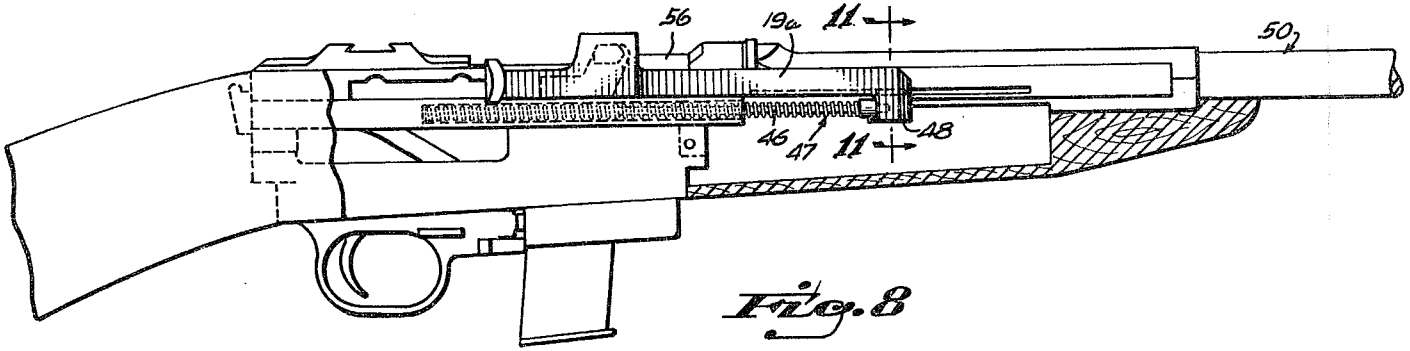
FIG. 8 is a right side elevational view of the standard military M1 carbine embodying the invention, with portions broken away to reveal constructional details.
Figure 9:
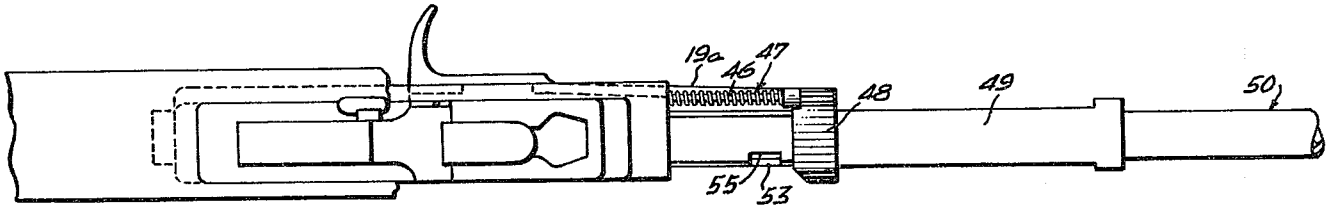
FIG. 9 is a fragmentary bottom view thereof.
Figure 10:
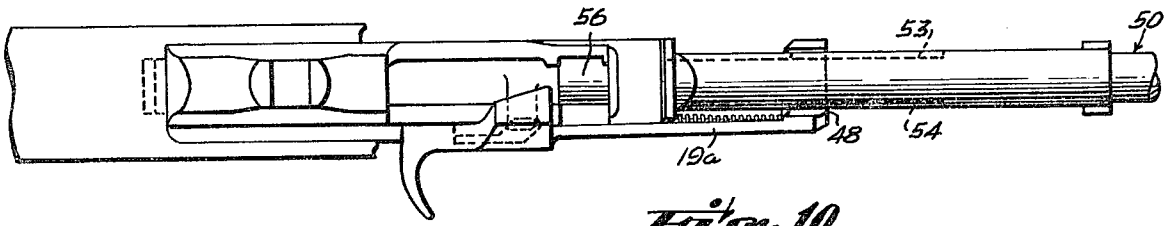
FIG. 10 is a fragmentary top view thereof.
Figure 11:
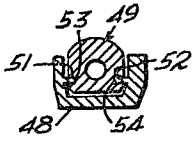
FIG. 11 is a vertical cross-sectional view, taken along the line 11—11 of FIG. 8 in the direction of the arrows.

FIGS. 8, 9, and 10 are similar to FIGS. 1, 2, and 3, respectively, described above, but show instead the modification for .22 caliber use of the standard military M1 carbine having the original design of operating slide **19*a*, operating slide guide rod 46 and slide spring 47. With reference to FIGS. 8, 10, and 11 it will be seen that in the original .30 caliber M1 (or M1A1) carbine construction, the operating slide 19*a* is formed with a front end portion 48 which surrounds the sides and underside of the rear portion 49 of barrel 50, and is guided therealong by opposed, inwardly-extending projections 51, 52 fitted in opposed longitudinally-extending recesses 53, 54. As illustrated in FIG. 9, a slot 55 opening into recess 53 at the forward end thereof permits removable assembly of the operating slide 19***a* to the gun barrel. It is to be noted that the operating slide 19*a* of the original M1 (or M1A1) carbine construction is not replaced for conversion to .22 caliber use of the gun, but merely has its forward end cut off to eliminate the excess weight of the member no longer needed for operation with .22 caliber use.

Since the operating slide 19*a* in the converted carbine will be guided in barrel recesses 53, 54 as described above, the substitute barrel 50 provided for conversion will lack entirely the gas cylinder port and piston assembly (not illustrated) otherwise required for semi-automatic .30 caliber ammunition operation.

The conversion and operation of the standard issue .30 caliber M1 carbine illustrated in FIGS. 8 through 11 is otherwise the same as illustrated and described above with respect to the slightly modified version of the original M1 carbine illustrated in FIGS. 1 through 6. Thus, as illustrated in FIGS. 8 and 10, the replacement barrel 50 for .22 caliber ammunition operation is similarly provided with a breech end extension portion 56 that limits the forward movement of the operating slide mechanism so as to provide for direct blow-back actuation thereof in semi-automatic operation.

Although I have illustrated and described my invention as applied to a technique or system of conversion of a standard .30 caliber M1 (or M1A1) carbine to .22 caliber use, it is also to be understood that the invention also comprehends the independent manufacturing or remanufacturing of .30 caliber M1 carbine style firearms to fire .22 caliber ammunition. As described above, I have found that this can be accomplished by limiting the forward sliding motion of the bolt so that it cannot turn into the bolt locking receiver slots 38, 38*b* (See FIG. 5). In the original manufacture or remanufacture of the .30 caliber M1 carbine prototype as a .22 caliber carbine, locking of the bolt at the breech, that is, rotation of the bolt as in .30 caliber operation, is expeditiously prevented simply by entirely eliminating the right and left receiver slots 38, 38*b*.

While I have illustrated and described herein only three forms in which my invention can conveniently be embodied in practice, it is to be understood that these embodiments are presented by way of example only and not in a limiting sense. My invention, in brief, comprises all the modifications and embodiments coming within the scope and spirit of the following claims.

What I claim as new and desire to secure by Letters Patent is:

1. In a modified to .22 caliber use United States Government Issue .30 caliber M1 or M1A1 semi-automatic carbine of the type having an original replaceable barrel, original receiver, original replaceable bolt assembly and original replaceable slide assembly before its modification to .22 caliber use, the improvement comprising, a replacement barrel having a .22 caliber bore substituted for the original barrel, a replacement bolt assembly of lesser weight than that of the original bolt assembly and substituted for the original bolt assembly, said replacement barrel having a rearwardly-extending breech portion operative, when assembled to the original receiver, to limit the foreward movement of said replacement bolt assembly fitted in the original receiver, thereby preventing said replaced bolt assembly being rotatively cammed into the receiver bolt assembly locking grooves, whereby said carbine will be converted from gas-propelled piston operation in which the original barrel piston uncams or unlocks the bolt to direct blow-back recoil operation with a .22 caliber ammunition, and a replacement operating slide substituted for the original slide assembly, said replacement operating slide being of such reduced overall weight as compared with the combined weight of the original operating slide and bolt assemblies replaced as provides for semi-automatic, direct blow-back recoil operation of the substituted bolt and slide mechanism without substantial loss of firing power, said replacement operating slide being fabricated of stamped sheet metal.

2. The invention defined in claim 1 and further including a .22 caliber magazine, said .22 caliber magazine having a casing directly receivable in the magazine slot of the original receiver.

3. In a modified to .22 caliber use United States Government Issue .30 caliber M1 or M1A1 semi-automatic carbine of the type having an original replaceable barrel, original receiver, original replaceable bolt assembly and original replaceable slide assembly before its modification to .22 caliber use, the improvement comprising, a replacement barrel having a .22 caliber bore substituted for the original barrel, a replacement bolt assembly of lesser weight than that of the original bolt assembly and substituted for the original bolt assembly, said replacement barrel having a rearwardly-extending breech portion operative, when assembled to the original receiver, to limit the foreward movement of said replacement bolt assembly fitted in the original receiver, thereby preventing said replaced bolt assembly being rotatively cammed into the receiver bolt assembly locking grooves, whereby said carbine will be converted from gas-propelled piston operation in which the original barrel piston uncams or unlocks the bolt to direct blow-back recoil operation with a .22 caliber ammunition, and a replacement operating slide substituted for the original slide assembly, said replacement operating slide being of such reduced overall weight as compared with the combined weight of the original operating slide and bolt assemblies replaced as provides for semi-automatic, direct blow-back recoil operation of the substituted bolt and slide mechanism without substantial loss of firing power, said replacement operating slide comprising an original government issue M1 operating slide, a forward end portion of which is cut away to reduce overall weight.

4. In a modified to .22 caliber use United States Government Issue .30 caliber M1 or M1A1 semi-automatic carbine of the type having an original replaceable barrel, original receiver, original replaceable bolt assembly and original replaceable slide assembly before its modification to .22 caliber use, the improvement comprising, a replacement barrel having a .22 caliber bore substituted for the original barrel, a replacement bolt assembly of lesser weight than that of the original bolt assembly and substituted for the original bolt assembly, said replacement barrel having a rearwardly-extending breech portion operative, when assembled to the original receiver, to limit the foreward movement of said replacement bolt assembly fitted in the original receiver, thereby preventing said replaced bolt assembly being rotatively cammed into the receiver bolt assembly locking grooves, whereby said carbine will be converted from gas-propelled piston operation in which the original barrel piston uncams or unlocks the bolt to direct blow-back recoil operation with a .22 caliber ammunition, and a replacement operating slide substituted for the original slide assembly, said replacement operating slide being of such reduced overall weight as compared with the combined weight of the original operating slide and bolt assemblies replaced as provides for semi-automatic, direct blow-back recoil operation of the substituted bolt and slide mechanism without substantial loss of firing power, said replacement barrel being devoid of a gas port and cylinder-piston assembly and being provided instead with a unitary support block for supporting the original operating slide guide mechanism.

* * * * *